US009415588B1

(12) United States Patent
Azuma et al.

(10) Patent No.: US 9,415,588 B1
(45) Date of Patent: Aug. 16, 2016

(54) INK-JET PRINTING APPARATUS AND INK-JET PRINTING METHOD

(71) Applicant: CANON KABUSHIKI KAISHA, Tokyo (JP)

(72) Inventors: Satoshi Azuma, Kawasaki (JP); Taku Yokozawa, Yokohama (JP); Hiroaki Shirakawa, Kawasaki (JP); Mitsutoshi Nagamura, Tokyo (JP); Yuhei Oikawa, Yokohama (JP); Hiroshi Taira, Fuchu (JP); Yosuke Ishii, Kawasaki (JP); Hiroaki Komatsu, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/059,165

(22) Filed: Mar. 2, 2016

(30) Foreign Application Priority Data

Mar. 5, 2015 (JP) ..... 2015-044055

(51) Int. Cl.
*B41J 2/045* (2006.01)

(52) U.S. Cl.
CPC ..... *B41J 2/04563* (2013.01); *B41J 2/04586* (2013.01)

(58) Field of Classification Search
CPC ..... B41J 2/04563; B41J 2/04586; B41J 2/03; B41J 2/04531; B41J 2/04538; B41J 2/0454; B41J 2/04553; B41J 2/04565; B41J 2/055; B41J 2/1408; B41J 2/17556; B41J 2002/14354; B41J 29/377
See application file for complete search history.

(56) References Cited

U.S. PATENT DOCUMENTS

2005/0024419 A1* 2/2005 Furukawa ..... B41J 2/0458 347/19
2009/0027437 A1* 1/2009 Azami ..... B41J 2/04563 347/17
2011/0221820 A1* 9/2011 Shibata ..... B41J 2/04563 347/17

FOREIGN PATENT DOCUMENTS

JP 7-209031 A 8/1995

* cited by examiner

*Primary Examiner* — Kristal Feggins
(74) *Attorney, Agent, or Firm* — Canon USA, Inc., IP Division

(57) ABSTRACT

In a case where the temperature difference between first and second time points detected by a first temperature sensor provided in a print head is lower than a threshold temperature, a temperature correction for the first temperature sensor is performed based on a temperature detected by a second temperature sensor provided within a printing apparatus thereof. In a case where the temperature difference is higher than the threshold temperature, a temperature correction for the first temperature sensor is performed without using the temperature detected by the second temperature sensor.

16 Claims, 11 Drawing Sheets

INK-JET PRINTING APPARATUS AND INK-JET PRINTING METHOD

BACKGROUND OF THE INVENTION

1. Field of the Invention

The present invention relates to an ink-jet printing apparatus and an ink-jet printing method.

2. Description of the Related Art

An ink-jet printing apparatus has been known conventionally in which a print head having a plurality of printing elements which generate power for discharging ink is driven so that ink can be discharged onto a printing medium for printing an image. It has been known that various temperature controls are executed based on temperatures detected by a temperature sensor provided in the print head in the ink-jet printing apparatus. Generally, a diode sensor having excellent heat responsiveness is used as the temperature sensor in the print head.

Such a diode sensor varies in characteristics due to manufacturing errors, and there is a possibility that a temperature deviation from an actual temperature may be detected due to error from a reference characteristic. In order to address this problem, Japanese Patent Laid-Open No. 7-209031 discloses an ink-jet printing apparatus internally having a temperature sensor separately from a diode sensor so that a detected value from the diode sensor can be corrected based on the detected value from the temperature sensor to calculate a correct temperature. Use of a thermistor of as the temperature sensor has also been known because manufacturing errors for thermistors do not occur easily though thermistors have lower heat responsiveness than that of diode sensors. More specifically, it is disclosed that, in a case where, for example, a detected temperature from a thermistor before printing is Tthr [° C.] and a detected temperature from a diode sensor is Tdef [° C.], a correction value Tadj (=Tthr−Tdef) is added to the detected temperature Tdi from the diode sensor under the temperature control to calculate a correct temperature.

Japanese Patent Laid-Open No. 7-209031 further discloses that a detected value from the diode sensor is corrected based on a detected value from the thermistor every predetermined period of time. It is disclosed that even when the correction is not performed on the diode sensor at a proper time point, the correction may be performed at the next time point so that the accuracy of the correction of the detected value from the diode sensor can be increased with a lapse of time.

SUMMARY OF THE INVENTION

It has been found that, when the print head is mounted to the ink-jet printing apparatus, the temperature within the print head may be largely different from the temperature within the ink-jet printing apparatus, and, there is a possibility in this case that the correction may not be executed properly on the diode sensor.

For example, when the temperature within the print head is significantly higher than the temperature within the ink-jet printing apparatus, the temperature within the print head decreases gradually after the print head is mounted within the ink-jet printing apparatus. In this case, the temperature detected by the diode sensor immediately after the print head is mounted, for example, is higher than the ambient temperature within the printing apparatus detected by the thermistor. Even though the correction of the detected value from the diode sensor is performed at this time point, the difference between the detected temperature from the diode sensor and the detected temperature from the thermistor includes a deviation due to manufacturing error of the diode sensor as well as an effect of an alienation between the temperature of the print head and the ambient temperature within the printing apparatus. As a result, the correction may not be executed properly.

In order to overcome this problem, the proper correction may be executed by executing the correction after the temperature of the print head decreases to a value closer to the temperature within the ink-jet printing apparatus. In this case, various temperature controls may not be executed until the correction is executed on the diode sensor, and a standby state may occur, taking time until the printing is started.

However, in accordance with the present invention, correction of a detected temperature from a temperature sensor provided in a print head can be executed properly without causing a waiting time.

For example, according to an aspect of the present invention, there is provided an ink-jet printing apparatus to which a print head is mountable for printing an image by driving the print head, the print head having at least a plurality of printing elements configured to generate power for discharging ink and a first detecting element configured to detect a temperature, the ink-jet printing apparatus including a second detecting element provided within the ink-jet printing apparatus and configured to detect a temperature, a first acquiring unit configured to acquire first information regarding a temperature detected by the first detecting element at a first time point after the print head is mounted to the ink-jet printing apparatus and acquire second information regarding a temperature detected by the first detecting element at a second time point after the first time point and before image printing is started, a second acquiring unit configured to acquire third information regarding a temperature detected by the second detecting element before the image printing is started, a third acquiring unit configured to acquire fourth information regarding a correction value for correcting the temperature detected by the first detecting element after the second time point, a correcting unit configured to correct the temperature detected by the first detecting element based on the correction value described in the fourth information acquired by the third acquiring unit after the second time point, and a control unit configured to control driving of the print head based on the temperature corrected by the correcting unit, wherein the third acquiring unit (i) acquires the fourth information regarding the correction value based on the temperature described in the second information acquired by the first acquiring unit and the temperature described in the third information acquired by the second acquiring unit in a case where a temperature difference between the temperature described in the first information and the temperature described in the second information acquired by the first acquiring unit is lower than a predetermined threshold, and (ii) acquires the fourth information regarding the correction value without using the third information acquired by the second acquiring unit in a case where the temperature difference between the temperature described in the first information acquired by the first acquiring unit and the temperature described in the second information is higher than the predetermined threshold.

Further features of the present invention will become apparent from the following description of exemplary embodiments with reference to the attached drawings.

DESCRIPTION OF THE EMBODIMENTS

Embodiments of the present invention will be described in detail below with reference to drawings.

First Embodiment

Figure 1:
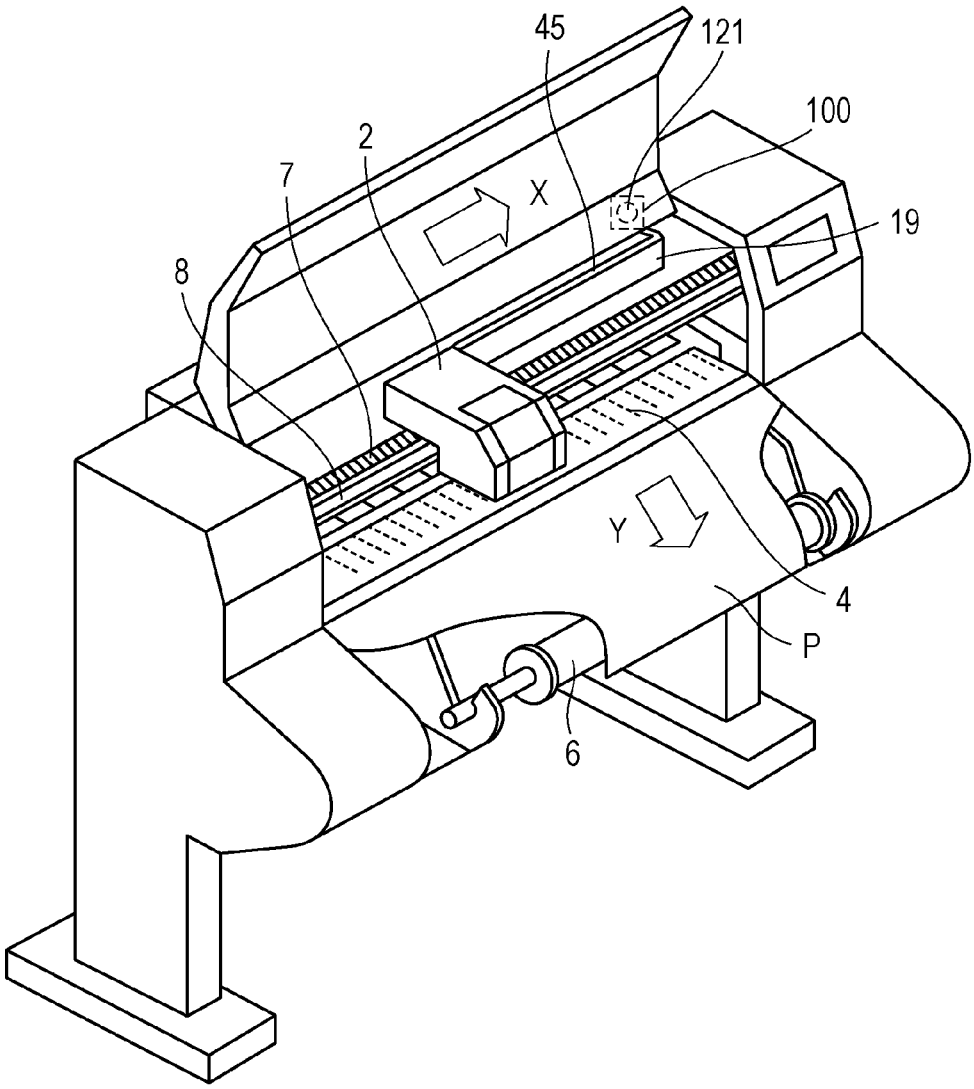
FIG. 1 is a perspective view of an ink-jet printing apparatus according to an embodiment.

FIG. 1 illustrates an outer appearance of an ink-jet printing apparatus (hereinafter, also called a printer) according to a first embodiment. This printer is of a serial scanning type capable of printing an image by scanning a print head in a cross direction (X direction) orthogonal to a conveyance direction (Y direction) of a printing medium P.

With reference to FIG. 1, a configuration and printing operations of the ink-jet printing apparatus will be described generally. First of all, a printing medium P is conveyed in the Y direction by a spool 6 holding the printing medium P with a conveying roller unit driven through gears by a line feed motor, not illustrated. On the other hand, a carriage unit 2 at a predetermined conveyance position is scanned along a guide shaft 8 extending in the X direction by a carriage motor, not illustrated. During this scanning processing, at a time point based on a positional signal acquired by an encoder 7, a discharge operation is performed from a discharge port in a print head (which will be described below) mountable in the carriage unit 2 so that a constant bandwidth corresponding to the array range of the discharge port is printed. According to this embodiment, the scanning is performed at a scanning speed of 40 inches per second, and the discharge operation is performed at a resolution of 600 dpi (1/600 inch). After that, the printing medium P is conveyed, and further printing with the next bandwidth is performed.

This type of printer may print an image on a unit region on a printing medium by performing one scan (so-called "one-path print") or may print an image by performing a plurality of scans (so-called "multi-path print"). In order to perform the one-path print, a printing medium may be conveyed by an amount equivalent to the bandwidth between scans. In order to perform the multi-path print, a plurality of scans may be performed on a unit region on a printing medium, and the unit region may be conveyed by an amount equivalent to about one band, without performing the conveyance for each scan. According to another method for the multi-path print, a printing medium may be fed by an amount equivalent to about 1/n band after data thinned by a predetermined mask pattern is printed thereon for each scan, and scanning is performed thereon again so that an image is completed by performing a plurality of (n) scans with different nozzles associated with printing and conveyances on a unit region of the printing medium.

A carriage belt may be used for transmission of a driving force from the carriage motor to the carriage unit 2. However, instead of such a carriage belt, other driving systems may be used including one having a lead screw which is driven to rotate by a carriage motor and extends in the X direction and an engaging portion which is provided in the carriage unit 2 and engages with a groove of the lead screw, for example.

The fed printing medium P is conveyed by being held between a feed roller and a pinch roller and is guided to a printing position (main scanning region of the print head) on a platen 4. In a normal stop state, a cap provided on a face of the print head is opened before a printing operation so that the print head or carriage unit 2 gets ready for scanning. After that, when data for one scan is accumulated in a buffer, the carriage unit 2 is caused to scan by the carriage motor for performing the printing processing as described above.

In this case, a flexible wiring substrate 19 is attached to the print head for supplying signal pulses for driving a discharge operation and a signal for head temperature adjustment. The flexible substrate has the other end connected to a control unit 100 (which will be described below) including a control circuit such as a CPU which executes control over this printer. A thermistor 121 (second detecting element) is provided in vicinity of the control unit. The thermistor 121 is a temperature sensor configured to detect an ambient temperature within the ink-jet printing apparatus.

The print head is connected to a plurality of independent main tanks corresponding to ink colors through a plurality of ink supply tubes 45. Thus, inks of colors stored in the main tanks can be supplied into the print head. Details of this ink supply system will be described below. The ink-jet printing apparatus further includes a capping mechanism (not illustrated) and a recovery mechanism (not illustrated). The capping mechanism is used for recovering and maintaining an ink discharge state of the print head 3 and can cover a discharge port of the print head. The recovery mechanism has a pump mechanism capable of suction of ink from the discharge port through the cap.

Figure 2:
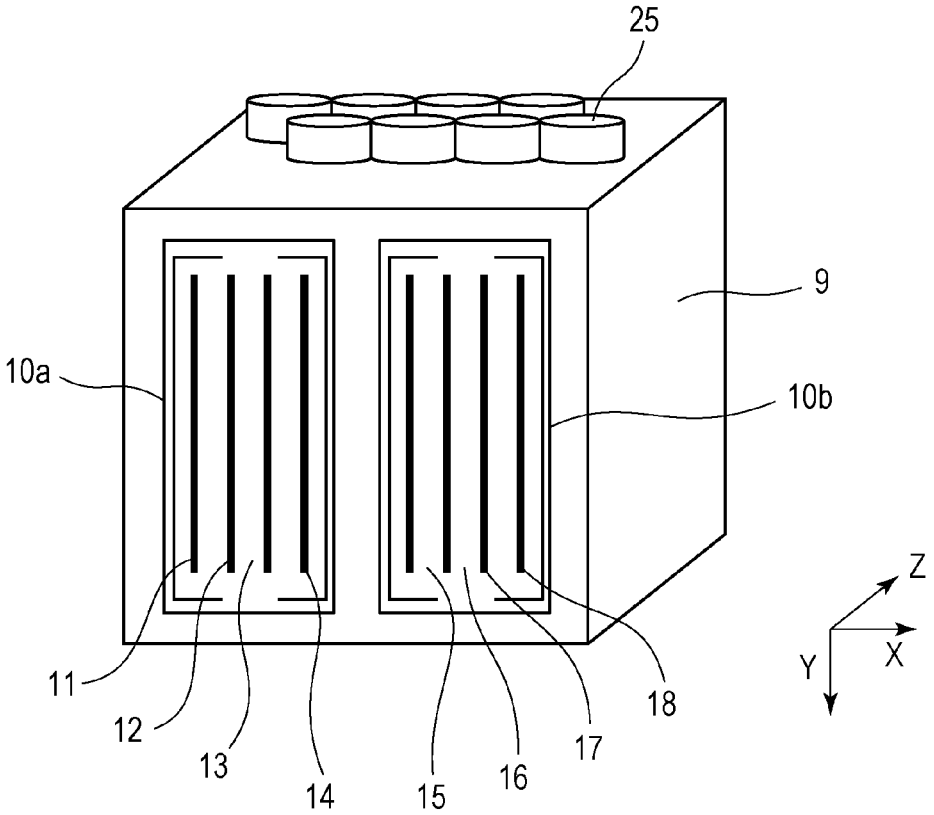
FIG. 2 is a schematic diagram of a print head according to an embodiment.

FIG. 2 is a perspective view schematically illustrating a print head 9 according to this embodiment.

The print head 9 has a joint portion 25, and the ink supply tube is connected to the joint portion 25.

Two printing element substrates 10*a* and 10*b* made of a semiconductor, for example, are attached to a discharge port surface facing a printing medium P of the print head 9. The printing element substrates 10*a* and 10*b* have discharge port arrays along the Y direction orthogonal to the X direction. In detail, the printing element substrate 10*a* has in the X direction a discharge port array 11 configured to discharge a black (Bk) ink, a discharge port array 12 configured to discharge a gray ink, a discharge port array 13 configured to discharge a light gray (Lgy) ink, and a discharge port array 14 configured to discharge a light cyan (Lc) ink. The printing element substrate 10*b* has in the X direction a discharge port array 15 configured to discharge a cyan (C) ink, a discharge port array 16 configured to discharge a light magenta (Lm) ink, a discharge port array 17 configured to discharge a magenta (M) ink, and a discharge port array 18 configured to discharge an yellow (Y) ink.

Printing element arrays, which will be described below, are provided at positions facing the discharge port arrays 11 to 18 behind the printing element substrates 10*a* and 10*b*. For simplicity, the printing element arrays at positions facing the discharge port arrays 11 to 18 will be called printing element arrays 11' to 18' below.

Figure 3A:
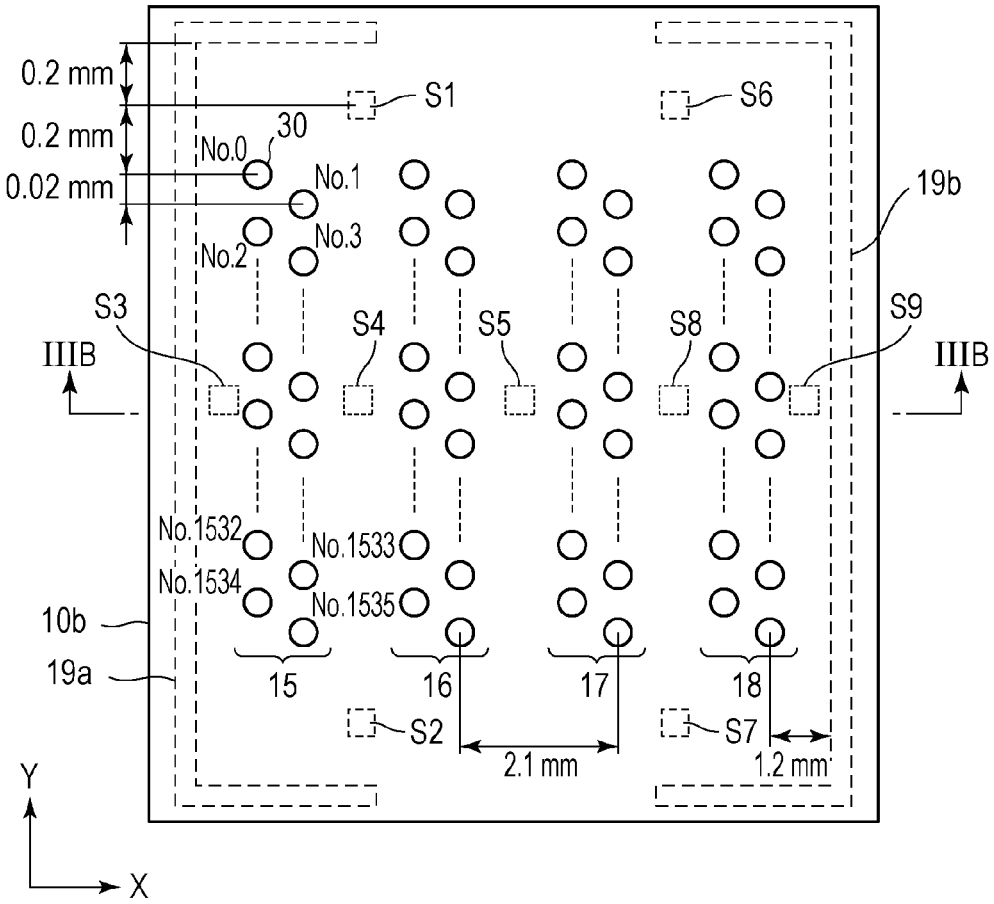
FIGS. 3A and 3B are opened-up views of the print head according to the embodiment.
Figure 3B:
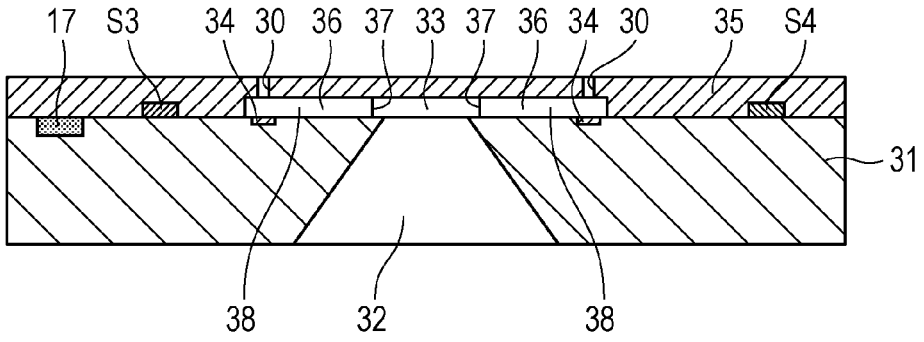

FIG. 3A is an open-up view of the printing element substrate 10*b* from a direction perpendicular to the XY plane. FIG. 3B is a cross section view from a downstream side of the Y direction of the printing element substrate 10*b* vertically taken at the line IIIB-IIIB in FIG. 3A, illustrating a state in vicinity of the discharge port array 15. For simplicity, FIGS. 3A and 3B illustrates the components at different dimension ration where the actual size of the printing element substrate 10*b* is 9.55 mm in the X direction and 39.0 mm in the Y direction.

Each of the discharge port arrays 11 to 18 according to this embodiment is arranged in two lines. These two lines have 768 discharge ports 30 each, a total of 1536 discharge ports 30, in the Y direction (the direction of the lines) and printing elements (hereinafter, also called main heaters) 34 in the Y direction (predetermined direction). The discharge ports 30 in the two lines are displaced by 1 dot from the opposite ones at 1200 dpi (dots/inch). The printing elements 34 are electrothermal transducers facing the discharge ports 30. According to this embodiment, 1200 dpi is equivalent to about 0.02 mm. By applying pulses to the printing elements, thermal energy for discharging ink from the discharge ports can be generated. Having described above that electrothermal transducers are used as the printing elements, piezoelectric transducers can be used instead.

A total of nine diode sensors (first detecting elements) S1 to S9 are provided on the printing element substrate 10*b* as temperature sensors configured to detect temperatures of ink in vicinity of the printing elements.

Two diode sensors S1 and S6 thereof are arranged in vicinity of one end portion in the Y direction of the discharge port arrays 15 to 18. More specifically, the diode sensors S1 and S6 are arranged at positions 0.2 mm away from the discharge ports at one end in the Y direction. The diode sensor S1 is arranged in the middle between the discharge port array 15 and the discharge port array 16 in the X direction, and the diode sensor S6 is arranged in the middle between the discharge port array 17 and the discharge port array 18 in the X direction.

Two diode sensors S2 and S7 are arranged in vicinity of the other end portion in the Y direction of the discharge port arrays 15 to 18. The diode sensor S2 is arranged in the middle between the discharge port array 15 and the discharge port array 16 in the X direction, and the diode sensor S7 is arranged in the middle between the discharge port array 17 and the discharge port array 18 in the X direction. More specifically, the diode sensors S2 and S7 are arranged at positions 0.2 mm away from the discharge ports at the other end in the Y direction.

Five diode sensors S3, S4, S5, S8, and S9 are arranged at the centers in the Y direction of the discharge port arrays 15 to 18. The diode sensor S4 is arranged in the middle between the discharge port array 15 and the discharge port array 16 in the X direction, and the diode sensor S5 is arranged in the middle between the discharge port array 16 and the discharge port array 17 in the X direction. The diode sensor S8 is arranged in the middle between the discharge port array 17 and the discharge port array 18 in the X direction. The diode sensor S3 is arranged outside the discharge port array 15 in the X direction, and the diode sensor S9 is arranged outside the discharge port array 18 in the X direction.

According to this embodiment, because the temperatures of ink within the discharge ports near the diode sensors are substantially equal to the temperature of the printing element substrate 10*b* at the position where the diode sensors are placed, the temperature of the printing element substrate 10*b* is handled as the temperature of the ink.

Heaters (hereinafter, also called sub-heaters) 19*a* and 19*b* configured to increase the temperature of ink within the discharge ports are provided on the printing element substrate 10*b*. The heater 19*a* continuously surrounds a side having the diode sensor S3 in the X direction of the discharge port array 15. Similarly, the heater 19*b* continuously surrounds a side having the diode sensor S9 in the X direction of the discharge port array 18. It should be noted that the heaters 19*a* and 19*b* position 1.2 mm outside the discharge port array 13 in the X direction and 0.2 mm outside the diode sensors S1, S2, S6, and S7 in the Y direction.

The printing element substrate 10*b* has thereon a substrate 31 having various circuits and a discharge port member 35 made of a resin, in addition to the diode sensors S1 to S9 and the sub-heaters 19*a* and 19*b*. A common ink chamber 33 is provided between the substrate 31 and the discharge port member 35, and an ink inlet 32 is communicated to the common ink chamber 33. An ink flow channel 36 extends from the common ink chamber 33, and the ink flow channel 36 is communicated to the discharge ports 30 in the discharge port member 35. A bubbling chamber 38 is provided at an end closer to the discharge ports 30 of the ink flow channel 36, and the bubbling chamber 38 has the printing elements (main heaters) 34 at positions facing the discharge ports 30. A nozzle filter 37 is provided between the ink flow channel 36 and the common ink chamber.

Having described the printing element substrate 10*b* in detail above, the printing element substrate 10*a* has substantially the same configuration.

According to this embodiment, a representative temperature is calculated based on temperatures detected by the diode sensors S1 to S9, and various temperature controls are executed based on the representative temperature. For simplicity, the temperature detected by the diode sensor S5 is used as the representative temperature for the various temperature controls below. However, this embodiment is not limited to a configuration in which a detected temperature from a single diode sensor is always used commonly for all temperature controls. For example, a combination of temperature sensors used for calculating the representative temperature for each type of temperature control can be changed. As an example, an average value of temperatures detected by the four diode sensors S1, S2, S3, and S4 surrounding the printing element array 15*x* may be used as the representative temperature when a driving pulse control which controls a driving pulse to be applied to the printing elements in accordance with the temperature is executed in the printing element array 15*x*. In order to perform the driving pulse control on the printing element array 17*x*, the surrounding four diode sensors S6, S7, S8, and S9 may be used. In order to keep warm the ink being used for printing, sub-heater heat control may be performed on the sub-heater 19*a* in which the sub-heater may be driven if the temperature of the ink is equal to or lower the predetermined threshold and the driving of the sub-heater is stopped if the temperature is higher than the predetermined threshold. In this case, a minimum value of temperatures detected by the three diode sensors S1, S2, and S3 in vicinity of the sub-heater 19*a* may be handled as the representative temperature. Furthermore, according to this embodiment, a plurality of diode sensors as illustrated in FIG. 3A are not required in the print head, but at least one diode sensor may be provided therein.

Figure 4:
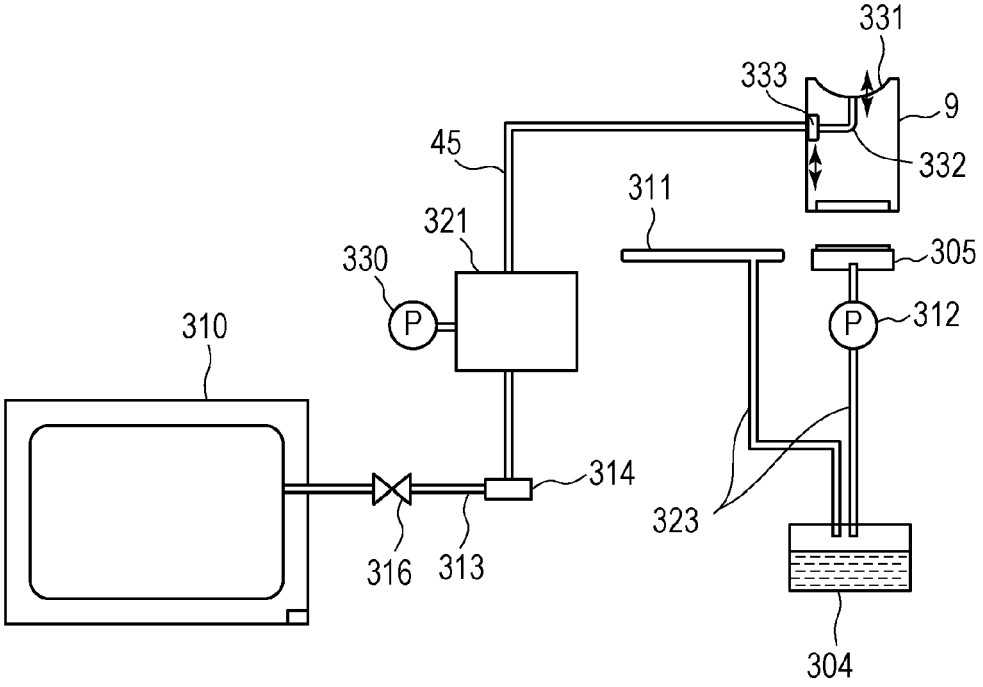
FIG. 4 is a diagram for explaining an ink supply system according to an embodiment.

FIG. 4 schematically illustrates an ink supply system and an output system according to this embodiment. Ink supplied from an ink tank 310 is supplied to the print head 9 through a supply path having an ink supply pipe 313, a joint 314, a pressurizing chamber 321, ink supply valve 316, a booster pump 330 and so on. The ink supply valve 316 is provided between the ink tank 310 and the pressurizing chamber 321 and opens and closes as required. The pressurizing chamber 321 is capable of storing a predetermined amount or less of ink. The booster pump 330 acts on the pressurizing chamber 321 and depressurizes the pressurizing chamber 321 to suck ink from the ink tank 310 and pressurizes the pressurizing chamber 321 to supply ink stored in the pressurizing chamber 321 to the print head 9. Ink (hereinafter, waste ink) which is discharged from the print head 9 but does not contribute to printing is collected by the cap 305 or an auxiliary discharging unit 311 and is stored (accumulated) in a waste ink accommodating unit 304 through a waste ink collection pipe 23.

The cap 305 is positioned off a printing region and is usable for protection and moisturizing of the ink discharge surface of the print head 9 when printing is not performed and is also usable for receiving auxiliary-discharged ink before printing is started or during printing and for suction recovery of the discharge surface of the print head 9. The waste ink settled within the cap 305 due to an auxiliary discharge is collected by the suction pump 312 and is stored in the waste ink accommodating unit 304 through the waste ink collection pipe 323. When a suction recovery is performed, the ink discharge surface of the print head 9 and the cap 305 are tightly attached. The suction pump 312 is operated to suck ink from the print head 9, and the ink is stored in the waste ink accommodating unit 304 through the waste ink collection pipe 323.

The auxiliary discharging unit 311 may be placed on the opposite side of the cap 305 off a printing region or may be placed at a proper position in the printing region. The waste ink settled in the auxiliary discharging unit 311 is stored in the waste ink accommodating unit 304 through the waste ink collection pipe 323 by gravity. The print head 9 has a wall partially including a flexible film 331. The flexible film 331 may stretch and shrink in accordance with the internal pressure change of the print head 9 due to ink consumption. A stretching or shrinking operation of the flexible film 331 is transmitted to an arm 332 connected to the flexible film 331 and is further transmitted to a valve 333 connected to a tip of the arm 332 on the opposite side of the flexible film 331. The valve 333 covers a connecting portion between the ink supply pipe 313 and the print head 9 and opens or closes in accordance with ink consume based on the mechanism as described above.

When one print head is mounted in an ink-jet printing apparatus for the first time, such as the time when the ink-jet printing apparatus is used first or the time when the print head is replaced, the ink supply system as described above is used to execute an initial ink filling operation. The initial ink filling operation will be described below in detail.

First, the booster pump 330 is used to depressurize inside of the pressurizing chamber 321 so that ink is led from the ink tank 310 to the ink supply pipe 313. Next, the ink supply valve 316 is opened, and the booster pump 330 is operated in the direction of depressurization so that ink led from the ink tank 310 is stored in the pressurizing chamber 321. When a predetermined amount of ink is stored, the depressurization is terminated, and the ink supply valve 316 is closed.

Next, the booster pump 330 is operated in the direction of pressurization to pressurize the ink stored in the pressurizing chamber 321 to a predetermined pressure level. Then, the cap 305 is tightly attached to the print head 9, and the suction pump 312 is operated to depressurize inside of the print head 9. Thus, the valve 333 is opened, and the ink can be supplied to the print head 9.

When a predetermined amount of ink is supplied into the print head 9, the operation of the suction pump 312 is stopped, and the cap 305 is separated from the print head 9. As a result, after ink is supplied until the valve 333 is closed by balance of negative pressure within the print head 9, the ink supply is terminated. Through the steps as described above, the initial ink filling operation on the print head 9 completes.

Figure 5:
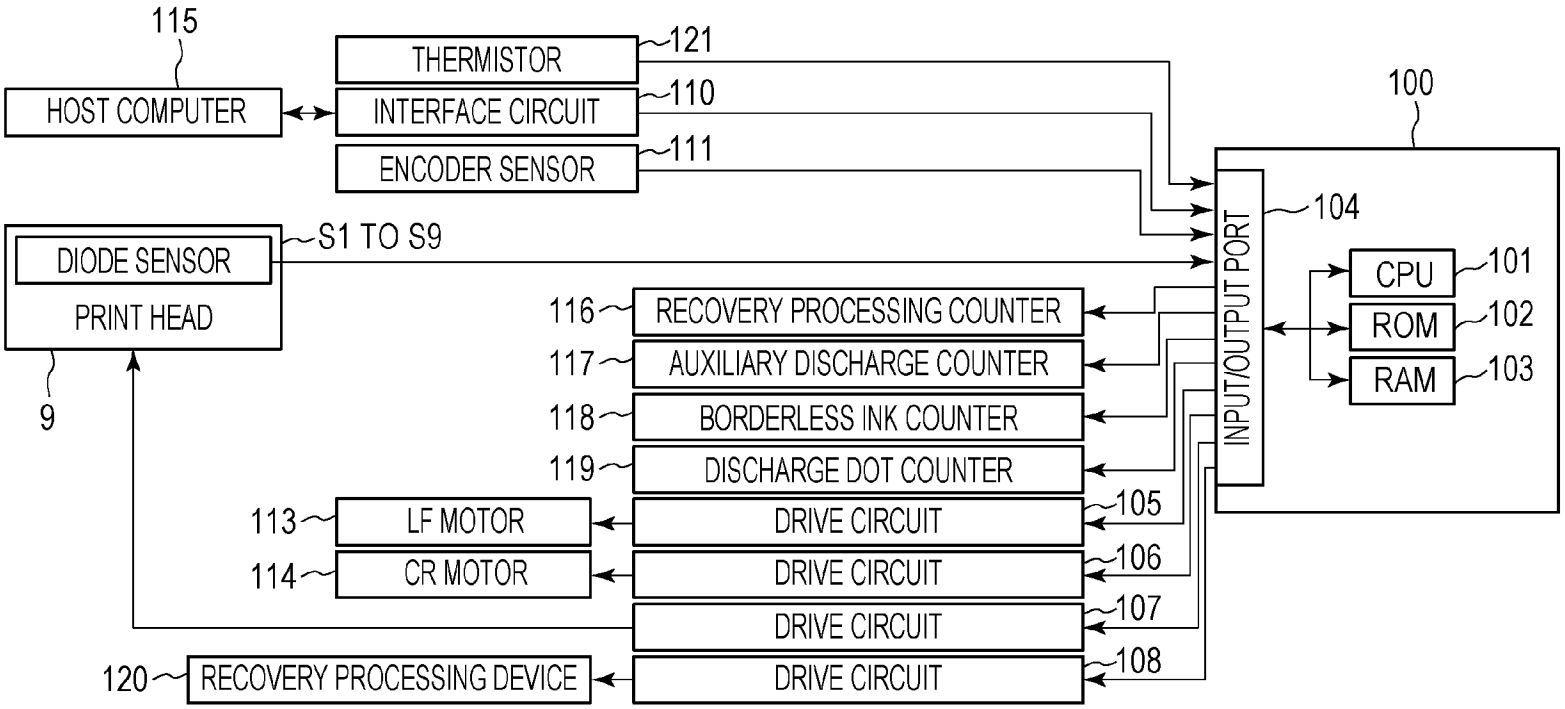
FIG. 5 illustrates a print control system according to an embodiment.

FIG. 5 is a block diagram illustrating a configuration of a control system mounted in a printing apparatus main body of the ink-jet printing apparatus according to this embodiment. The main control unit 100 includes a CPU 101 configured to perform processing operations including calculation, control, identification, and setting. The main control unit 100 further includes a ROM 102 configured to store a control program to be executed by the CPU 101, a buffer configured to store binary print data indicative of an ink discharge/non-discharge state, a RAM 103 usable as a work area for processing performed by the CPU 101, and an input/output port 104. The RAM 103 is also usable as a storage unit configured to store the amount of ink in the main tank and a remaining capacity of a sub-tank before and after a printing operation. Drive circuits 105, 106, 107, and 108 for a line feed motor (LF motor) 113 configured to drive a conveying roller unit, a carriage motor (CR motor) 114, the print head 9, and a recovery processing device 120, respectively, are connected to the input/output port 104. These drive circuits 105, 106, 107, and 108 are controlled by the main control unit 100. Sensors are connected to the input/output port 104, such as the diode sensors S1 to S9 configured to detect the temperature of the print head 9, an encoder sensor 111 fixed to the carriage 2, and the thermistor 121 configured to detect an ambient temperature (environment temperature) within the printing apparatus. The main control unit 100 is connected to a host computer 115 through an interface circuit 110.

A recovery processing counter 116 counts the amount of ink when the recovery processing device 120 forces the print head 9 to output ink. An auxiliary discharge counter 117 counts auxiliary discharges performed before a printing operation is started, when a printing operation ends, and during a printing operation. A borderless ink counter 118 counts ink printed outside a printing medium region when borderless printing is performed, and a discharge dot counter 119 counts ink discharged during a printing operation.

Displacements of a gradient (a) due to manufacturing error of diode sensors are not found greatly where the relationship of voltage to temperatures in diode sensors used according to this embodiment is represented by a linear function (y=ax+b). On the other hand, the offset value represented by intercept (b) is significantly displaced when manufacturing error occurs. According to this embodiment, a thermistor having less effect of manufacturing error is provided within the ink-jet printing apparatus as described above, and the offset values for the diode sensors within the print head are corrected by using a detected temperature from the thermistor at every predetermined time interval. A diode correction value Tadj for correcting the offset value can be calculated by Expression (1). For simplicity, it is defined below that a temperature detected by a diode sensor for calculating the correction value Tadj is Tdi and that a temperature detected by the thermistor for calculating the correction value Tadj is Tthr.

$$Tadj = Tthr - Tdi \quad (1)$$

The calculated correction value Tadj is stored in the RAM 103. The correction value is used when a temperature control such as a driving pulse control and a sub-heater heat control is performed. Correcting a temperature detected by a diode sensor can correct the offset value of the diode sensor.

Figure 12:
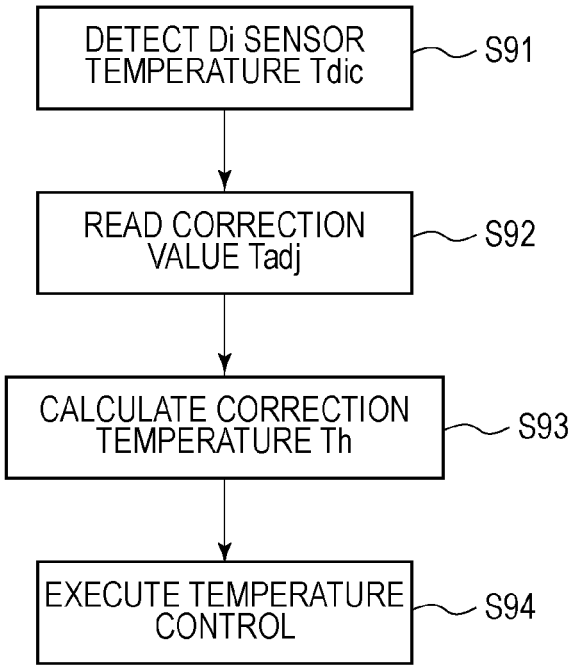
FIG. 12 is a flowchart illustrating processing for calculating a correction temperature according to an embodiment.

FIG. 12 is a flowchart illustrating processing for acquiring a correction temperature when a temperature control is executed. For simplicity, hereinafter, a temperature acquired from a diode sensor under a temperature control will be called Tdic, and a corrected temperature after a correction is performed will be called Th.

First, a temperature Tdic detected by a diode sensor immediately before a temperature control is executed is acquired in step S91. Next, in step S92, a correction value Tadj stored in the RAM 103 is read out. In step S93, a correction temperature Th is calculated in accordance with an expression (Expression (2)) for correction of a temperature detected by a diode sensor.

$$Th=Tdic+Tadj \quad (2)$$

As understood from Expression (1) and Expression (2), if the detected temperature of the thermistor is higher than the detected temperature from a diode sensor upon calculation of a correction value, the correction temperature is higher than the temperature before the correction (Th>Tdic). Conversely, if the detected temperature from the thermistor is lower, the correction temperature is lower than the temperature before the correction (Th<Tdic).

Then, the correction temperature Th calculated in step S94 is used to execute a temperature control. It should be noted that various controls can be executed as the temperature control, and, for example, a driving pulse control, a sub-heater heating control, a short-pulse heating control may be executed.

With the configuration as described above, proper correction processing can be executed for correcting a detected temperature from a diode.

Method for Determining Improper Correction

In a case where the correction processing is performed on a detected temperature from a diode as described above when a print head is mounted to the ink-jet printing apparatus for the first time, there is a possibility that the deviation of the offset value may be larger in some states of the print head, compared with a case where the correction processing is not executed. Hereinafter, such a correction will also be called an improper correction. The improper correction significantly occurs particularly when the temperature of the print head is largely different from the ambient temperature within the ink-jet printing apparatus and the print head is not adapted to the ambient temperature within the printing apparatus. An improper correction causing mechanism will be described in detail below.

Figure 6A:
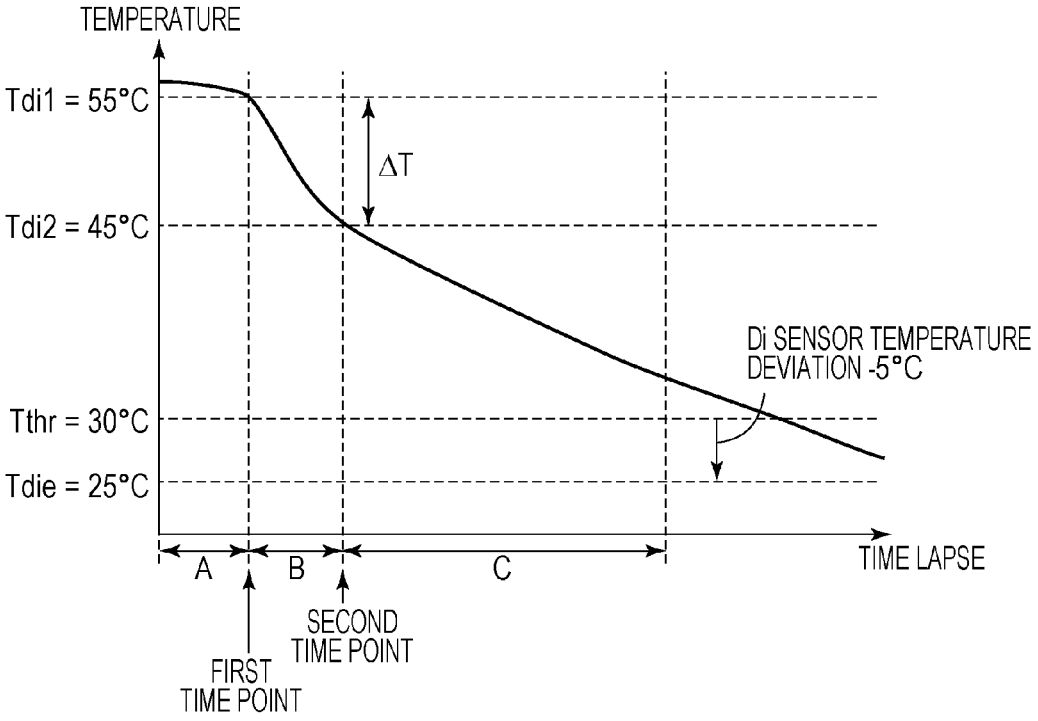
FIGS. 6A and 6B schematically illustrate changes in temperature detected by a diode sensor.
Figure 6B:
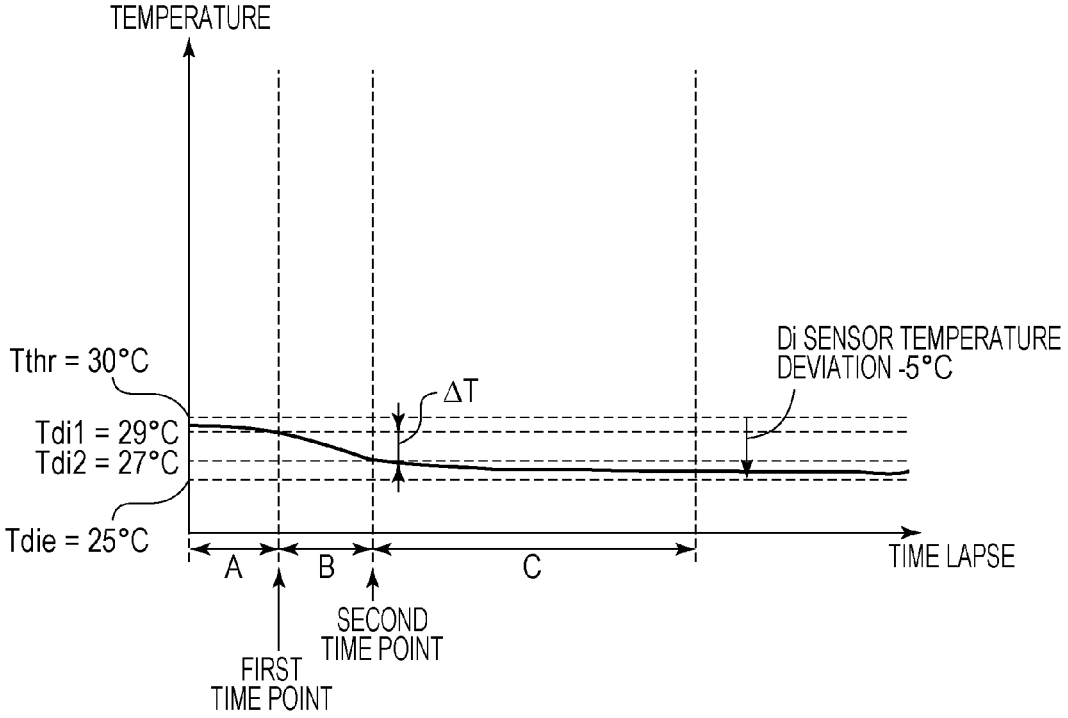

FIGS. 6A and 6B illustrate changes in detected temperature from a diode sensor when the print head is mounted to the ink-jet printing apparatus. A case will be described in which the ambient temperature is 30° C., for example. It is further assumed in that case that a detection error of the diode sensor is occurring in which the detected temperature from the diode sensor is 5° C. lower than an actual temperature (diode-sensor detected temperature deviation=−5° C.), for example. Thus, the detected temperature Tdie from the diode sensor when the temperature of the print head is completely adapted to the ambient temperature within the printing apparatus is 25° C. Therefore, an ideal correction value Tadj for matching the detected temperature from the diode with the temperature from the thermistor is 5° C.

FIG. 6A illustrates changes in detected temperature from the diode sensor in a case where the temperature of the print head when mounted is relatively higher than the ambient temperature within the ink-jet printing apparatus. FIG. 6B illustrates changes in detected temperature from the diode sensor in a case where the temperature of the print head when mounted is not different from the ambient temperature within the ink-jet printing apparatus greatly. A period A in FIGS. 6A and 6B is a period from the mount of the print head to the printing apparatus to the start of an initial ink filling operation. A period B is a period from the start of the initial ink filling operation to the end of the operation. A period C is a period when the print head is tightly closed with the cap 305 after the initial filling operation performed by the print head ends.

As illustrated in FIG. 6A, when the temperature of the print head is significantly higher than the ambient temperature (30° C.) of the printing apparatus, heat dissipation occurs within the printing apparatus since the print head is mounted to the printing apparatus. Then, the temperature of the print head gradually decreases (period A). Thus, a temperature Tdi1 detected by the diode sensor at a time point (first time point) immediately before the initial ink filling operation starts is 55° C. Because of the deviation of detected temperature from the diode sensor as described above, the actual temperature of the print head at the first time point is 60 (=55+5)° C.

From the first time point, the initial ink filling operation as described above is executed (period B). Here, the temperature of ink within the ink tank 310 is about 30° C. because it is sufficiently adapted to the ambient temperature. The ink having a significantly lower temperature than the temperature of the print head is filled within the print head so that the temperature of the print head more rapidly decreases than the period A due to heat transfer to ink. As a result, a temperature Tdi2 detected by the diode sensor decreases to 45° C. at a time point (second time point) immediately after the end of the initial ink filling operation. Also at the second time point, the actual temperature of the print head is different from the detected temperature from the diode sensor and is 50 (=45+5)° C., like the first time point. Because the ambient temperature is 30° C., the print head is not still adapted to the ambient temperature within the printing apparatus even at the second time point.

The ink filling operation is not performed from the second time point until an ink discharge operation is started (period C). On the other hand, heat exchange is continuously performed on the ink already filled in the print head so that the temperature of the print head decreases until the temperature of the print head is substantially equal to the ambient temperature within the printing apparatus.

There is a high possibility that performing a temperature correction for the diode sensor in accordance with Expressions (1) and (2) when there is an alienation between the temperature of the print head and the ambient temperature within the printing apparatus may result in an increase of the deviation of detected temperature due to manufacturing error of the diode sensor compared with a case without performing the temperature correction. This point will be described below as an example of the case there a temperature correction is executed at the second time point in FIG. 6A.

At the second time point, the detected temperature Tdi2 from the diode sensor is 45° C., and the detected temperature Tthr from the thermistor is 30° C. Thus, calculating the diode correction value Tadj in accordance with Expression (1), Tadj=−15° C. is acquired. As described above, the ideal correction value Tadj is equal to 5° C. for the diode sensor. On the other hand, when the temperature correction is not performed, the correction value Tadj corresponds to 0° C. In other words, though the deviation of correction value Tadj from the ideal correction value when a temperature correction is not performed is −5 (=0−5)° C., performing the temperature correction result in a deviation of −20(=−15−5)° C. of correction value Tadj from the correction value. Performing the temperature correction further increases the deviation of detected temperature (improper correction).

On the other hand, as illustrated in FIG. 6B, the temperature of the print head is not different from the ambient temperature (30° C.) of the printing apparatus greatly, the decreases in temperature do not significantly occur in the periods A, B, and C. More specifically, the detected temperature Tdi1 from the diode sensor at the first time point is equal to 29° C., and the detected temperature Tdi2 from the diode sensor at the second time point is equal to 27° C.

As in FIG. 6A, when the temperature correction is performed at the second time point, a relationship of diode correction value Tadj=3 (=30−27)° C. is acquired. As described above, the ideal correction value Tadj for the diode sensor is equal to 5° C. Therefore, in the case illustrated in FIG. 6B, performing the temperature correction can bring the correction value Tadj closer to the proper value.

There may be considered that the difference between the results of the temperature correction processing performed in the cases in FIGS. 6A and 6B may depend on whether the correction processing is performed after the print head is adapted to the ambient temperature within the printing apparatus or not. In the case illustrated in FIG. 6A, the print head has not been adapted yet to the ambient temperature within the printing apparatus even at the second time point, and there occurs an alienation between the temperature of the print head and the ambient temperature within the printing apparatus. Therefore, because the correction value Tadj calculated at the second time point is more strongly influenced by the difference between the temperature of the print head and the ambient temperature within the printing apparatus than the effect of deviation of detected temperature due to manufacturing error of the diode sensor, the correction value Tadj is deviated from the ideal correction value. On the other hand, in the case in FIG. 6B, the print head has already been adapted to the ambient temperature within the printing apparatus at the second time point, and the temperature of the print head has a value substantially equal to the ambient temperature within the printing apparatus. Therefore, a proper correction value Tadj can be calculated.

In view of this point, according to this embodiment, the temperature correction is performed if the print head has been adapted to the ambient temperature within the printing apparatus, and the temperature correction is not performed if not. Then, the detected temperature from the diode sensor is directly used as the correction temperature without making any change thereto.

Whether the print head has been adapted to the ambient temperature within the printing apparatus or not may be determined by using a difference between the detected temperature Tdi1 from the diode sensor at the first time point and the detected temperature Tdi2 from the diode sensor at the second time point.

As illustrated in FIG. 6A, if the print head has not been adapted to the ambient temperature within the printing apparatus, the detected temperature from the diode largely decreases due to the initial ink filling operation. Thus, the absolute value ΔT of the difference between the diode detected temperatures Tdi1 and Tdi2 between the first and second time points is relatively as large as 10 (=55−45)° C.

On the other hand, as illustrated in FIG. 6B, if the print head has been adapted to the ambient temperature within the printing apparatus, the diode detected temperatures do not change greatly even when the initial ink filling operation is performed. More specifically, the absolute value ΔT of the difference between the diode detected temperatures Tdi1 and Tdi2 between the first and second time points is relatively as small as 2 (=29−27)° C.

From this, it is understood that whether the print head has been adapted to the ambient temperature within the printing apparatus or not can be determined based on a difference in detected temperatures from the diode sensor during the initial ink filling operation.

Processing for Correcting Diode-Sensor-Detected Temperature

In view of the aforementioned point, according to this embodiment, a difference between temperatures detect from the diode sensor before and after the initial ink filling operation performed when the print head is mounted for the first time. If the temperature difference is lower than a predetermined threshold, it is determined that the effect of an improper correction is small. Then, the detected temperature from the thermistor is used to execute the processing for correcting a detected temperature from the diode sensor. On the other hand, if the temperature difference is higher than the predetermined threshold, it is determined that the effect of an improper correction is large. Then, the processing for correcting a detected temperature from the diode sensor by using a detected temperature from the thermistor is not executed.

Figure 7:
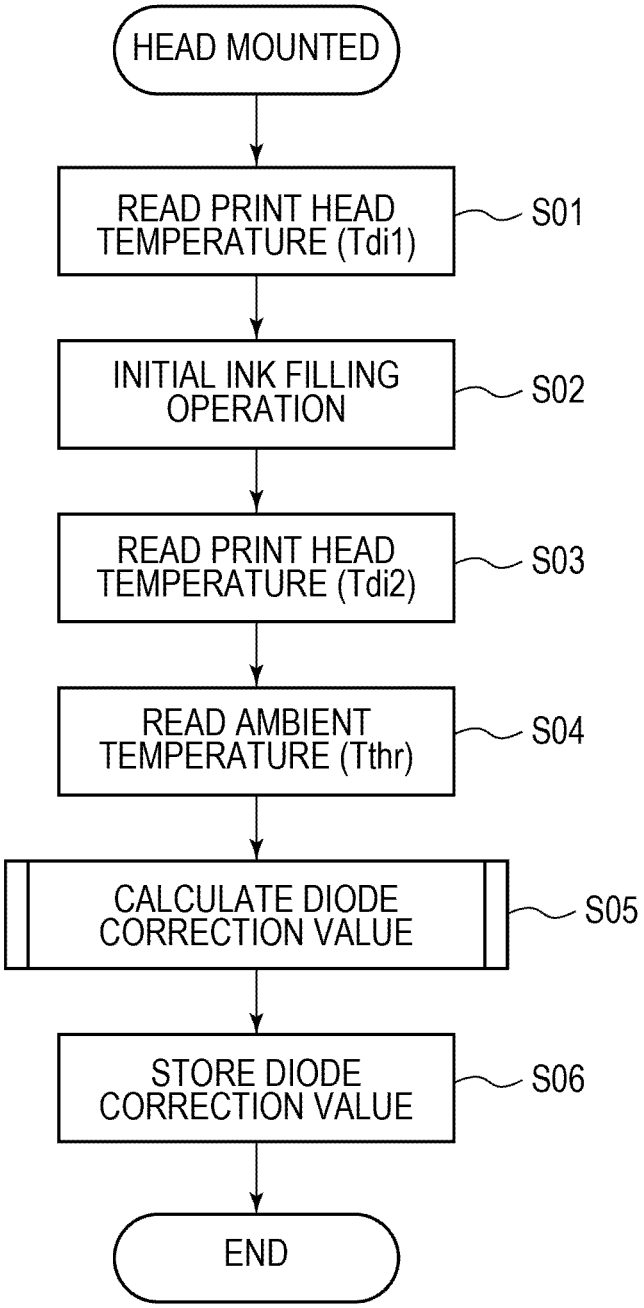
FIG. 7 illustrates a method for acquiring a diode correction value according to an embodiment.

FIG. 7 is a flowchart for a control program for acquiring a parameter for executing diode correction processing according to this embodiment.

After the print head is mounted to the printing apparatus for the first time, a detected temperature Tdi1 is acquired from the diode sensor S5 mounted in the print head 9 at the first time point immediately before an ink filling operation starts (step S01). Information describing the acquired detected temperature Tdi1 is further stored in the RAM 103.

Next, the initial ink filling operation as described above is executed (step S02). It should be noted that the operation to be performed in step 02 is conventionally executed if a print head is mounted to a printing apparatus for the first time. Therefore, the execution of step S02 does not increase the waiting time for a user compared with the conventional processing.

Next, a detected temperature Tdi2 is acquired from the diode sensor S5 at the second time point immediately after the initial ink filling operation ends (step S03). Information describing the acquired detected temperature Tdi2 is further stored in the RAM 103. It should be noted that whether the initial ink filling operation has ended or not may be determined based on whether the time period measured from the start of the initial ink filling operation exceeds a predetermined initial ink filling operation period. Alternatively, it may be determined based on whether the count of the remaining ink amount within the ink tank 310 decreases by a predetermined initial ink filling amount or not.

Next, a detected temperature Tthr is acquired from the thermistor 121 provided within the printing apparatus (step S04). As described above, the detected temperature Tthr indicates the ambient temperature within the printing apparatus. Information describing the acquired detected temperature Tthr is stored in the RAM 103.

Next, a diode-correction-value process is executed for acquiring the correction value Tadj for correction of an offset value of the diode sensor (step S05). The diode-correction-value calculation process will be described below.

The correction value Tadj acquired in step S05 is stored in the RAM 103 (step S06). In the subsequent temperature control, the detected temperature Tdic acquired from the diode sensor and the correction value Tadj stored in the RAM 103 are used to acquire a correction temperature Th in accordance with Expression (2). By executing the temperature control based on the correction temperature Th, proper temperature control can be performed.

Figure 8:
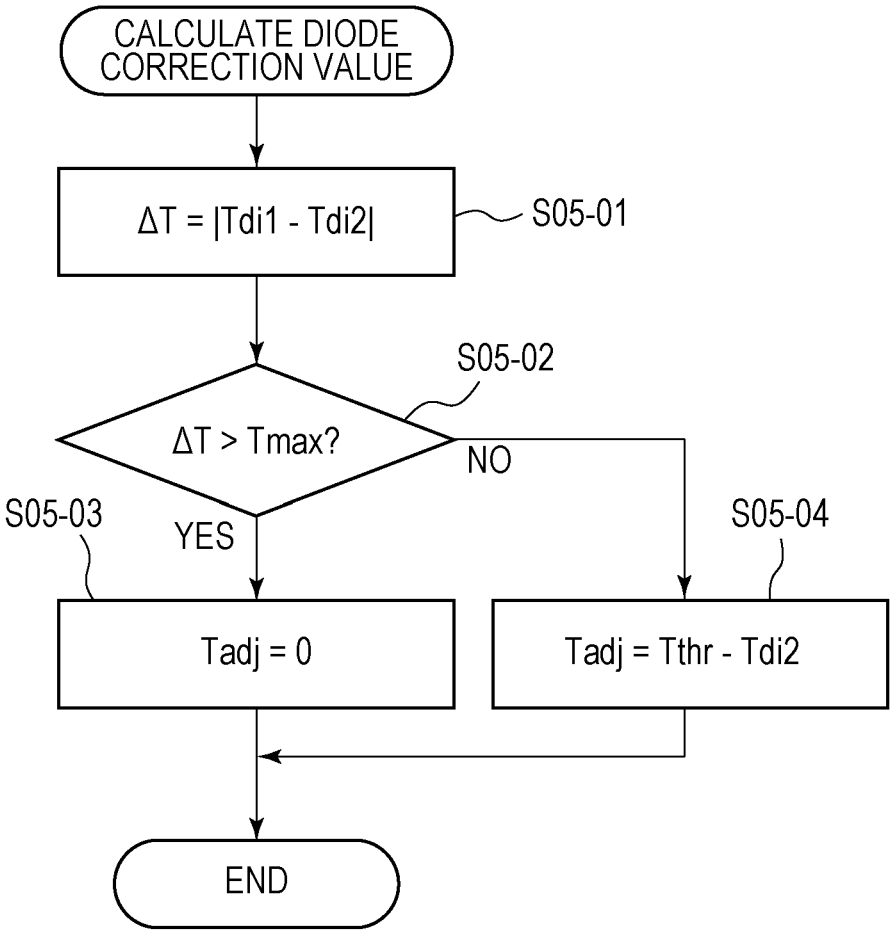
FIG. 8 illustrates the method for acquiring a diode correction value according to the embodiment.

FIG. 8 is a flowchart for a control program for executing diode correction processing according to this embodiment.

First, a temperature difference ΔT in detected temperature from the diode sensor S5 before and after the initial ink filling operation is calculated (step S05-01). More specifically, an absolute value of the difference between the detected temperature Tdi1 at the first time point acquired in step S01 and the detected temperature Tdi2 at the second time point acquired in step S03 is calculated as the temperature difference ΔT. There is a possibility that the improper correction as described above may be performed in both cases where the temperature of the print head is significantly higher than the ambient temperature within the printing apparatus and where it is significantly lower conversely. The use of the absolute value of the difference can prevent the temperature difference ΔT having a negative value.

Next, whether the temperature difference ΔT calculated in step S05-01 is larger than a predetermined threshold temperature Tmax or not is determined (step S05-02). The threshold temperature Tmax is a temperature predetermined in view of the possibility of the improper correction and may be take any of various values based on the thermal capacity of the print head 9 and reading errors of the diode sensor. According to this embodiment, the threshold temperature Tmax is 7° C.

If it is determined in step S05-02 that the temperature difference ΔT is higher than the threshold temperature Tmax, it is determined that the possibility of occurrence of an improper correction is higher because there is a possibility that the print head has not been adapted to the ambient temperature within the printing apparatus as illustrated in FIG. 6A. Then, a temperature correction is performed without using the detected temperature from the thermistor. It is assumed here that the diode correction value Tadj is 0 (step S05-03). Thus, the subsequent temperature control is based on the relationship Th=Tdic as in Expression (2). In other words, the detected temperature Tdic from the diode sensor in each temperature control is directly used as the correction temperature Th. This is because the deviation from the actual temperature can be easily small when the detected temperature from the diode sensor is directly used rather than correction performed with the print head which has not sufficiently adapted to the ambient temperature within the printing apparatus.

Having described the case where the diode correction value Tadj is equal to 0 in step S05-03, other configurations may also applicable. For example, a print head may be calibrated in advance in a factory, and a diode correction value Tfact in the factory may be written to an EEPROM, for example, provided in the print head as a predetermined value. Then, in step S05-03, the relationship of diode correction value Tadj=Tfact may be applied. Thus, the diode sensor reading error of print head temperature can be reduced properly.

On the other hand, if it is determined in step S05-02 that the temperature difference ΔT is equal to or lower than the threshold temperature Tmax, it is determined the possibility of occurrence of improper correction is low because there is a high possibility that the print head has already been adapted to the ambient temperature within the printing apparatus as illustrated in FIG. 6B. Thus, the diode correction value Tadj is calculated in accordance with Expression (1) above (step S05-04). Since the detected temperature Tdi2 from the diode sensor, which is acquired in step S03, is used for calculating a correction value according to this embodiment, the relationship of correction value Tadj=Tthr−Tdi2 is satisfied. In this case, a detected temperature Tdi3 from the diode sensor may be acquired again at another time point close to the first and second time points and may be used for calculating the correction value so that the relationship of Tadj=Tthr−Tdi3 can be satisfied. In this configuration, even when the print head is mounted to the printing apparatus for the first time, the temperature difference ΔT can be relatively small so that an improper correction does not occur easily. Thus, the diode-sensor temperature correction processing using a thermistor within the printing apparatus can be performed properly.

As described above, according to this embodiment, when the difference in detected temperature from a diode sensor between the first and second time points is relatively high, the diode-sensor temperature correction processing using a thermistor is not performed. Thus, improper corrections which may possibly occur when the print head has not been adapted to the ambient temperature within the printing apparatus can be reduced. On the other hand, when the detected temperature difference is relatively low, the diode-sensor temperature correction processing using the thermistor is performed. Thus, when the print head has been adapted to the ambient temperature within the printing apparatus and there is a low possibility that an improper correction may occur, the difference due to manufacturing error of the diode sensor can be reduced. Furthermore, because the temperature difference before and after the initial ink filling operation is used for determining whether there is a high possibility that an improper correction may occur or not, proper temperature correction processing can be performed without waiting time for users.

Second Embodiment

According to the first embodiment, a correction value Tadj for correcting a diode-sensor detected temperature immediately after a print head is mounted to a printing apparatus for the first time, and the correction value Tadj is used to correct the diode-sensor detected temperature in the subsequent temperature control.

On the other hand, according to a second embodiment, the correction value Tadj is calculated again at a predetermined time point after the correction value Tadj is calculated first, and the correction value Tadj is updated at every predetermined time point.

The description regarding the same parts as those in the first embodiment will be omitted.

According to the first embodiment, if it is determined that a print head has not been adapted to the ambient temperature within a printing apparatus immediately after the print head is mounted thereto, the diode correction value Tadj is set to 0. In this case, an improper correction can be avoided, but the setting of correction value Tadj=0 is continuously used in the subsequent temperature adjustment processing.

On the other hand, according to this embodiment, the diode-sensor detected temperature correction processing is executed again after a lapse of a predetermined threshold time period after one printing job ends and the print head is closed with the cap (cap close). The threshold time period may be a time period enough for the temperatures of the print head and the printing apparatus to decrease to a normal temperature after the cap close. According to the second embodiment, the threshold time period is 60 minutes.

Figure 9:
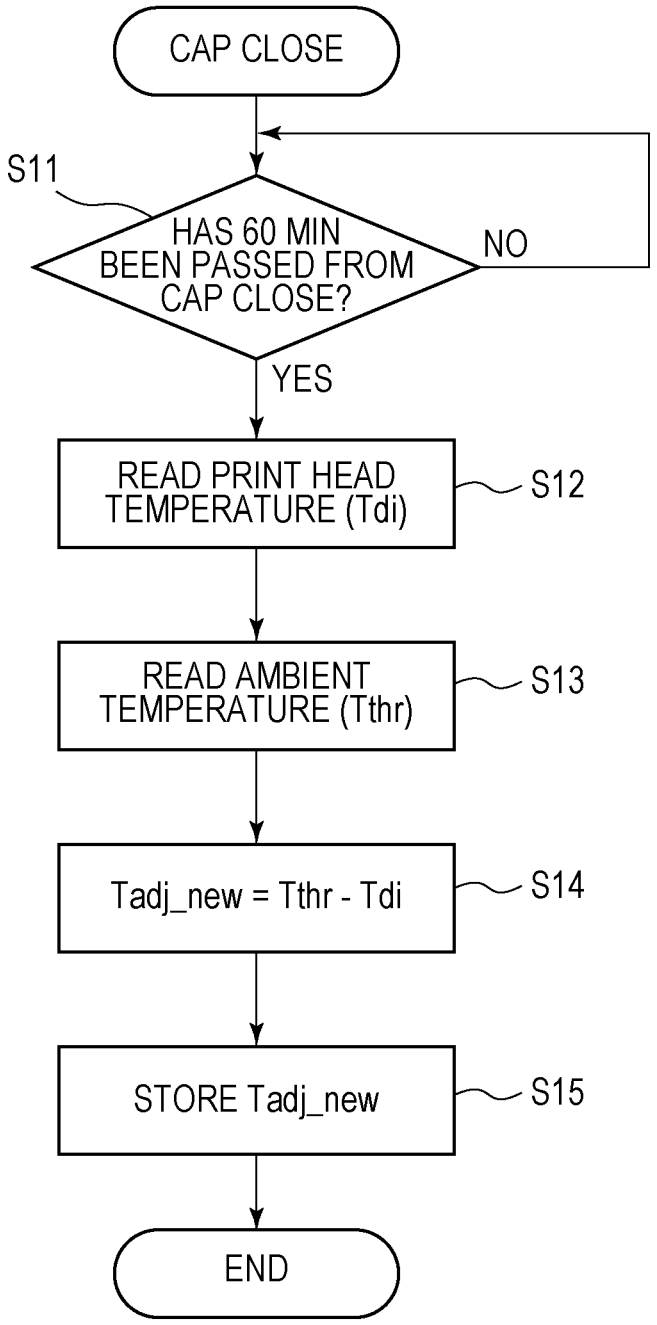
FIG. 9 illustrates the method for acquiring a diode correction value according to the embodiment.

FIG. 9 is a flowchart of a control program for executing diode correction processing according to this embodiment.

If it is determined that 60 minutes has been passed since the execution of the cap close (step S11), a detected temperature Tdi from the diode sensor is acquired (step S12). Next, a detected temperature Tthr is acquired from the thermistor (step S13). Next, a new relationship of diode correction value Tadj_new=Tthr−Tdi is calculated in accordance with Expression (1) (step S14). The newly calculated relationship of correction value Tadj_new is stored in the RAM 103, and the correction value Tadj calculated last time is updated to correction value Tadj_new (step S15). In the subsequent temperature control, the correction value Tadj_new stored in step S15 to correct a detected temperature from the diode sensor.

In the configuration as described above, even in a case where it is determined that the print head has not been adapted to the ambient temperature within the printing apparatus when the print head is mounted to the printing apparatus and the temperature correction is not executed, the diode-sensor detected temperature correction can be performed again after the cap close. Therefore, proper temperature control can be executed after the cap close.

Having described that the temperature correction is executed again after a lapse of a threshold time period from the cap close, the temperature correction may be executed after a period for the temperatures of the printing apparatus and the print head mounted in the printing apparatus to decrease substantially to a normal temperature instead of the cap close period. For example, the diode-sensor detected temperature correction may be executed immediately after the printing apparatus is powered on after a lapse of a threshold time period or longer since the printing apparatus is powered off.

Having described that the temperature correction processing is executed every time the cap close is executed, other configurations are also possible. For example, the temperature correction processing illustrated in FIG. 9 may not be executed even when the cap close is executed after a predetermined number of the temperature correction processing illustrated in FIG. 9 may be performed. Then, the correction value Tadj_new acquired by the last temperature correction processing may be used to execute the temperature control.

Third Embodiment

According to the first and second embodiments, if the temperature difference ΔT between the first and second time points is lower than the threshold temperature Tmax, the correction value Tadj is commonly defined as Tadj=Tthr−Tdi2.

According to a third embodiment on the other hand, if the temperature difference ΔT between the first and second time points is lower than the threshold temperature Tmax, the value of the correction value Tadj is differentiated in accordance with the value of the temperature difference ΔT.

The descriptions regarding the same parts as those in the first and second embodiments will be omitted.

Figure 10:
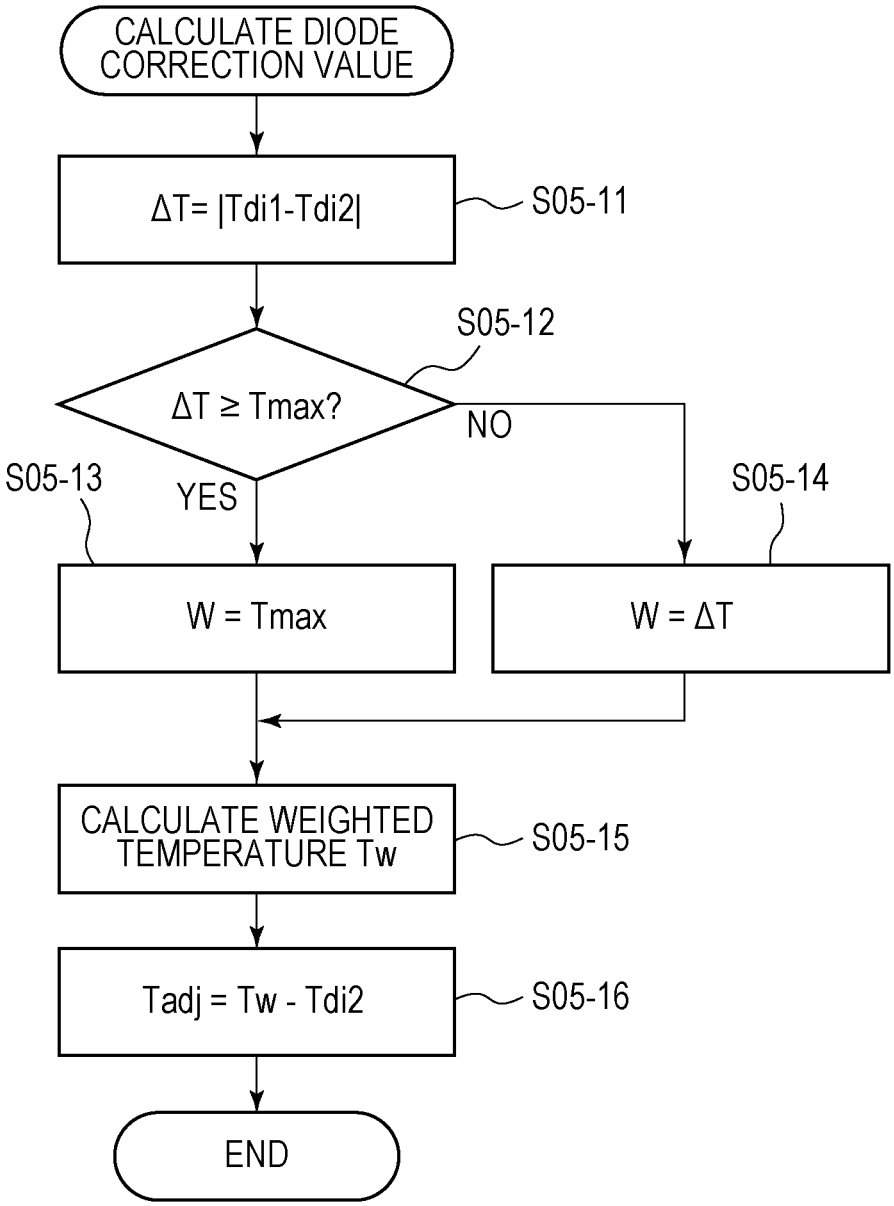
FIG. 10 illustrates the method for acquiring a diode correction value according to the embodiment.

FIG. 10 is a flowchart describing a control program for executing diode correction processing according to the third embodiment.

The description regarding steps S05-11 and S05-12 in FIG. 10 will be omitted because they are the same as steps S05-01 and S05-02 in FIG. 8.

Next, in steps S05-13 and S05-14, a weight coefficient W is calculated. If it is determined in step S05-12 that the temperature difference ΔT is equal to or higher than a threshold temperature Tmax, the weight coefficient W is set to the threshold temperature Tmax (step S05-13). On the other hand, if it is determined in step S05-12 that the temperature difference ΔT is lower than the threshold temperature Tmax, the weighting coefficient W is set to the value matched with the temperature difference ΔT (step S05-14).

Next, the weight coefficient W calculated in step S05-13 or step S05-14 is used to calculate a weighted temperature Tw in accordance with Expression (3) below (step S05-15). Expression (3) will be described below.

$$Tw = \frac{Tthr * (Tmax - W) + Tdi2 * W}{Tmax} \tag{3}$$

The weighted temperature Tw calculated in step S05-16 is used to calculate a correction value Tadj in accordance with Expression (4) below (step S05-16).

$$Tadj = Tw - Tdi2 \tag{4}$$

The correction value Tadj is stored in the RAM 103, and the diode-sensor detected temperature is corrected by using a correction temperature calculated by using the correction value Tadj in accordance with Expression (2) above in the subsequent temperature control processing.

The weighted temperature will be described in detail below. The following descriptions assume a case where the threshold temperature Tmax is equal to 10° C. and that the thermistor detected temperature Tthr is equal to 25° C., for example.

Figure 11:
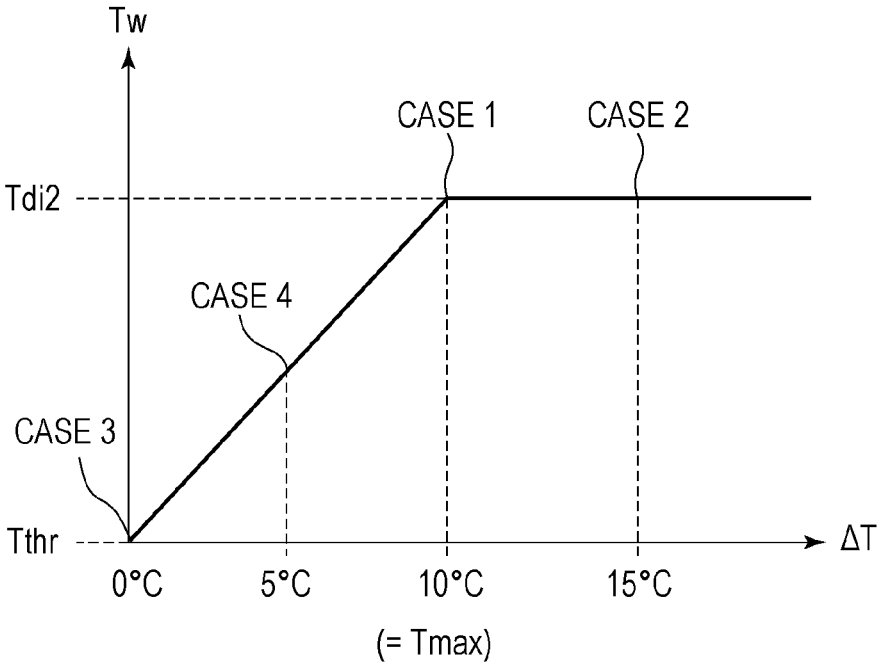
FIG. 11 illustrates weighted temperatures according to an embodiment.

FIG. 11 is a graph illustrating a correlation between weighted temperature Tw and temperature difference ΔT.

First, as described above, according to this embodiment, if the temperature difference ΔT is equal to or higher than the threshold temperature Tmax, weight coefficient W=Tmax is set in step S05-14. In this case, Expression (3) is expanded as in Expression (5).

$$Tw = Tdi2 \tag{5}$$

Therefore, as illustrated in FIG. 11, if the temperature difference ΔT is equal to or higher than the threshold temperature Tmax (=10° C.), the weighted temperature Tw is matched with the diode-sensor detected temperature Tdi2 at the second time point. Furthermore, it is understood from Expression (4) that if the temperature difference ΔT is equal to or higher than the threshold temperature Tmax, the relationship of correction value Tadj=0 is acquired. From this, the process in step S05-13 according to this embodiment is substantially identical to the process in step S05-03 in FIG. 8 according to the first embodiment.

On the other hand, if the temperature difference ΔT is lower than the threshold temperature Tmax, weight coefficient W=ΔT is set in step S05-14. In this case, Expression (3) is expanded as in Expression (6) below:

$$Tw = \frac{Tdi2 - Tthr}{Tmax} * \Delta T + Tthr \tag{6}$$

From this, it is understood, as illustrated in FIG. 11, if the temperature difference ΔT is lower than the threshold temperature Tmax (=10° C.), the weighted temperature Tw increases as the temperature difference ΔT increases. If temperature difference ΔT=0, the weighted temperature Tw is matched with the thermistor detected temperature Tthr. If temperature difference ΔT=Tmax, the weighted temperature Tw is matched with the diode-sensor detected temperature Tdi2 at the second time point. Furthermore, referring to Expression (4), if the temperature difference ΔT is lower than the threshold temperature Tmax, the correction value Tadj can be calculated by Expression (7) below:

$$Tadj = \frac{Tmax - \Delta T}{Tmax} * (Tthr - Tdi2) \quad (7)$$

From this, it is understood that, in the process in step S05-14 according to this embodiment, if the temperature difference ΔT is lower than the threshold temperature Tmax, the correction value Tadj is a value which may be acquired by multiplying the difference Tthr−Tdi2 between the thermistor detected temperature and the diode-sensor detected temperature at the second time point by a coefficient (Tmax−ΔT)/Tmax which varies in accordance with the temperature sensor ΔT. The coefficient (Tmax−ΔT)/Tmax increases as the temperature difference ΔT decreases. Thus, it is understood that a the absolute value of the correction value Tadj to be calculated increases as the temperature difference ΔT decreases. It is understood that, if temperature difference ΔT=0, the correction value Tadj is matched with the difference Tthr−Tdi2 between the thermistor detected temperature Tthr and the diode-sensor detected value Tdi2 at the second time point while if temperature difference ΔT=Tmax, the correction value Tadhj is equal to 0.

Hereinafter, cases where the temperature difference ΔT is 10° C., 15° C., 0° C., and 5° C. will be called Case 1, Case 2, Case 3, and Case 4, respectively. Diode correction processing according to this embodiment will be described below in detail.

Examples of temperature relationships corresponding to Cases 1 to 4 are given in Table 1.

TABLE 1

| | Case 1 | Case 2 | Case 3 | Case 4 |
|---|---|---|---|---|
| Tdi1 | 45° C. | 55° C. | 30° C. | 35° C. |
| Tdi2 | 35° C. | 40° C. | 30° C. | 30° C. |
| ΔT | 10° C. | 15° C. | 0° C. | 5° C. |
| Tmax | | | 10° C. | |
| Tthr | | | 25° C. | |
| W | 10 | 10 | 0 | 5 |
| Tw | 35° C. | 40° C. | 25° C. | 27.5° C. |
| Tadj | 0° C. | 0° C. | −5° C. | −2.5° C. |

Case 1

It is understood that temperature difference ΔT=10° C. in step S05-11 in FIG. 10 because Tdi1=45° C. and Tdi2=35° C. Because ΔT Tmax in step S05-12, the processing moves to step S05-13. In step S05-13, a relationship of W=Tmax=10° C. is acquired. As in Expression (5), in step S05-15, a relationship of Tw=Tdi is acquired by substituting W=Tmax to Expression (3). Furthermore, a relationship of Tadj=0 is acquired as described above in step S05-16. This means that the correction processing is not executed to inhibit occurrence of an improper correction because, in Case 1, the temperature difference ΔT during the initial ink filling is larger than the threshold temperature Tmax and there is a high possibility that the print head has not been adapted to the ambient temperature within the printing apparatus.

Case 2

It is understood that, in step S05-11 in FIG. 10, because Tdi1=55° C. and Tdi2=40° C., temperature difference ΔT=15° C., which is further higher than the temperature difference ΔT in Case 1. Thus, Tadj=0 is acquired like Case 1.

Case 3

It is understood that, in step S05-11 in FIG. 10, because Tdi1=30° C. and Tdi2=30° C., temperature difference ΔT=0° C. which means that no change occurs in the temperature of the print head during the initial ink filling. Because ΔT<Tmax in step S05-12, the processing moves to step S05-14. In step S05-14, a relationship of W=ΔT=0 is acquired. In step S05-15, a relationship of Tw=Tthr=25 is acquired by substituting W=0 into Expression (3). Furthermore, in step S05-16, a relationship of Tadj=Tw−Tdi2=−5 is acquired from Expression (4). In Case 3, the temperature difference ΔT is equal to 0 during the initial ink filling, and it may be considered that the print head has been completely adapted to the ambient temperature within the printing apparatus. Therefore, the correction processing as in the first embodiment is executed.

Case 4

In step S05-11 in FIG. 10, because Tdi1=35° C. and Tdi2=30° C., temperature difference ΔT=5° C. Thus, it is understood that a change in the temperature of the print head is approximately in the middle between Case 1 and Case 3 during the initial ink filling operation. Because ΔT<Tmax in step S05-12, the processing moves to step S05-14. In step S05-14, a relationship of W=ΔT=5 is acquired. Tw=27.5 is acquired by substituting W=5 into Expression (3) in step S05-15. In step S05-16, a relationship of Tadj=Tw−Tdi2=−2.5 is acquired from Expression (4). As described above, if the temperature difference ΔT is lower than the threshold temperature Tmax, it is understood that the absolute value of the correction value Tadj in a case where the temperature difference ΔT is relatively high (Case 4) is lower than a case where it is relatively low (Case 3).

In Case, because the temperature difference ΔT during the initial ink filling operation is approximately in the middle between Case 1 and Case 3 as described above, the degree of adaptation of the print head to the ambient temperature within the printing apparatus is considered to be approximately in the middle between Case 1 and Case 3. Therefore, according to this embodiment, also in Case 4, the correction processing is executed, but the degree (strength) of the correction may be weaker than the first embodiment. In other words, it is learned that the factors for the deviation of diode-sensor detected temperature include both of "deviation due to manufacturing error of the diode sensor" and "deviation due to lack of adaptation to the ambient temperature" to some extent. Thus, the effects of both of them are taken into consideration for the temperature calibration.

With the configuration as described above, if the temperature difference ΔT between the first and second time points is lower than the threshold temperature Tmax, the value of the correction value Tadj can be differentiated in accordance with the value of the temperature difference ΔT.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Having described that, according to the aforementioned embodiments, the temperature detection from the thermistor is performed only once in the temperature correction processing, other configurations may also be possible. For example, the ambient temperature may be read before and after an initial ink filling operation, that is, twice, and the difference may be subtracted as an ambient temperature change ΔTthr from the print head temperature change ΔT. Thus, the effect of the ambient temperature change during the initial ink filling operation can be reduced. In a concrete example, in a case where the difference ΔT in diode-sensor detected temperature is equal to 3° C. and the difference ΔTthr in thermistor detected temperature is equal to 1° C., the actual difference in diode-sensor detected temperature can be calculated as 2 (=3−1)° C.

Having described that according to the aforementioned embodiments, the temperature correction processing is executed by using a temperature difference before and after an initial ink filling operation, other configuration may also be possible. For example, the time immediately after the start of an initial ink filling operation may be the first time point, and the time immediately after the end of the operation may be the second time point. A temperature difference between during an operation may be used instead of the initial ink filling operation. The period may be included in a period in which a change in temperature of the print head can be detected if the temperature of the print head has not been adapted to the ambient temperature within the printing apparatus, in which an operation necessary for functioning the printing apparatus, and in which ink is discharged for the first time from a print head mounted to the printing apparatus.

According to the ink-jet printing apparatus and ink-jet printing method of the present invention, a detected temperature from a temperature sensor provided in a print head therein can be corrected without waiting time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-044055, filed Mar. 5, 2015, which is hereby incorporated by reference herein in its entirety.

What is claimed is:

1. An ink-jet printing apparatus to which a print head is mountable for printing an image by driving the print head, the print head having at least a plurality of printing elements configured to generate power for discharging ink and a first detecting element configured to detect a temperature, the ink-jet printing apparatus comprising:

a second detecting element provided within the ink-jet printing apparatus and configured to detect a temperature;

a first acquiring unit configured to acquire first information regarding a temperature detected by the first detecting element at a first time point after the print head is mounted to the ink-jet printing apparatus and acquire second information regarding a temperature detected by the first detecting element at a second time point after the first time point and before image printing is started;

a second acquiring unit configured to acquire third information regarding a temperature detected by the second detecting element before the image printing is started;

a third acquiring unit configured to acquire fourth information regarding a correction value for correcting the temperature detected by the first detecting element after the second time point;

a correcting unit configured to correct the temperature detected by the first detecting element based on the correction value described in the fourth information acquired by the third acquiring unit after the second time point; and a control unit configured to control driving of the print head based on the temperature corrected by the correcting unit, wherein the third acquiring unit (i) acquires the fourth information regarding the correction value based on the temperature described in the second information acquired by the first acquiring unit and the temperature described in the third information acquired by the second acquiring unit in a case where a temperature difference between the temperature described in the first information and the temperature described in the second information acquired by the first acquiring unit is lower than a predetermined threshold, and (ii) acquires the fourth information regarding the correction value without using the third information acquired by the second acquiring unit in a case where the temperature difference between the temperature described in the first information acquired by the first acquiring unit and the temperature described in the second information is higher than the predetermined threshold.

2. The ink-jet printing apparatus according to claim 1, wherein the third acquiring unit acquires the fourth information regarding the correction value by handling a predetermined value as the correction value in a case where the temperature difference between the temperature described in the first information and the temperature described in the second information acquired by the first acquiring unit is higher than the predetermined threshold.

3. The ink-jet printing apparatus according to claim 2, the predetermined value is equal to 0.

4. The ink-jet printing apparatus according to claim 1, wherein the third acquiring unit acquires the fourth information regarding the correction value based on a temperature difference between the temperature described in the second information acquired by the first acquiring unit and the temperature described in the third information acquired by the second acquiring unit in a case where the temperature difference between the temperature described in the first information and the temperature described in the second information acquired by the first acquiring unit is lower than the predetermined threshold.

5. The ink-jet printing apparatus according to claim 4, wherein the third acquiring unit acquires the fourth information regarding the correction value by handling the temperature difference between the temperature described in the second information acquired by the first acquiring unit and the temperature described in the third information acquired by the second acquiring unit as the correction value in a case where the temperature difference between the temperature described in the first information and the temperature described in the second information acquired by the first acquiring unit is lower than the predetermined threshold.

6. The ink-jet printing apparatus according to claim 4, wherein the third acquiring unit (i) acquires the fourth information regarding the correction value by handing a value acquired by multiplying the temperature difference between the temperature described in the second information acquired by the first acquiring unit and the temperature described in the third information acquired by the second acquiring unit by a first coefficient as the correction value in a case where the temperature difference between the temperature described in the first information and the temperature described in the second information acquired by the first acquiring unit is equal to a first value lower than the predetermined threshold and (ii) acquires the fourth information regarding the correction value by handling a value acquired by multiplying the temperature difference between the temperature described in the second information acquired by the first acquiring unit and the temperature described in the third information acquired by the second acquiring unit by a second coefficient lower than the first coefficient as the correction value in a case where the temperature difference between the temperature described in the first information and the temperature described in the second information acquired by the first acquiring unit is lower than the predetermined threshold and is equal to a second value higher than the first value.

7. The ink-jet printing apparatus according to claim 1, wherein the correcting unit (i) corrects the temperature detected by the first detecting element such that the temperature corrected by the correcting unit can be higher than the temperature detected by the first detecting element in a case where the temperature difference between the temperature described in the first information and the temperature described in the second information acquired by the first acquiring unit is lower than a predetermined threshold and the temperature described in the third information acquired by the second acquiring unit is higher than the temperature described in the second information acquired by the first acquiring unit, and (ii) corrects the temperature detected by the first detecting element such that the temperature corrected by the correcting unit can be lower than the temperature detected by the first detecting element in a case where the temperature difference between the temperature described in the first information and the temperature described in the second information acquired by the first acquiring unit is lower than the predetermined threshold and the temperature described in the third information acquired by the second acquiring unit is lower than the temperature described in the second information acquired by the first acquiring unit.

8. The ink-jet printing apparatus according to claim 1, wherein the first and second time points are included in a period since the print head is mounted to the ink-jet printing apparatus for the first time until ink is discharged from the print head for the first time.

9. The ink-jet printing apparatus according to claim 8, wherein the first time point is a time point before a time point when ink filling to the print head is started, and the second time point is a time point after a time point when the ink filling to the print head ends.

10. The ink-jet printing apparatus according to claim 8, wherein the second acquiring unit acquires the third information regarding a temperature detected by the second detecting element at a third time point included in a period since the ink filling to the print head is started until ink is discharged from the print head for the first time.

11. The ink-jet printing apparatus according to claim 1, wherein the correcting unit corrects temperatures detected by the first detecting element based on the correction value described in the fourth information acquired by the third acquiring unit until a fourth time point after the start of image printing and after a lapse of a time period in which ink discharge is not performed longer than a predetermined threshold time period.

12. The ink-jet printing apparatus according to claim 11, wherein the first acquiring unit further acquires fifth information regarding a temperature detected by the first detecting element at a time point after the fourth time point and before image printing is started for the first time after the fourth time point;

the second acquiring unit further acquires sixth information regarding a temperature detected by the second detecting element at a time point after the fourth time point and before image printing is started for the first time after the fourth time point;

the third acquiring unit further acquires seventh information regarding a correction value for correcting a temperature detected by the first detecting element after the fourth time point based on the temperature described in the fifth information acquired by the first acquiring unit and the temperature described in the sixth information acquired by the second acquiring unit; and the correcting unit corrects a temperature detected by the first detecting element after the fourth time point based on a correction value described in the seventh information acquired by the third acquiring unit.

13. The ink-jet printing apparatus according to claim 1, wherein the print head has a plurality of the first detecting elements;

the first acquiring unit acquires, as the first and second information, information regarding representative temperatures calculated based on a plurality of temperatures detected by the plurality of first detecting elements; and the correcting unit corrects, based on a correction value described in the fourth information acquired by the third acquiring unit, the representative temperatures calculated based on a plurality of temperatures detected by the plurality of first detecting elements after the second time point.

14. The ink-jet printing apparatus according to claim 1, wherein the second detecting element is configured to detect an ambient temperature within the ink-jet printing apparatus.

15. An ink-jet printing apparatus to which a print head is mountable for printing an image by driving the print head, the print head having at least a plurality of printing elements configured to generate power for discharging ink and a first detecting element configured to detect a temperature, the ink-jet printing apparatus comprising:

a second detecting element provided within the ink-jet printing apparatus and configured to detect a temperature;

a first acquiring unit configured to acquire first information regarding a temperature detected by the first detecting element at a first time point after the print head is mounted to the ink-jet printing apparatus and acquire second information regarding a temperature detected by the first detecting element at a second time point after the first time point and before image printing is started, and acquire third information regarding a temperature detected by the first detecting element at a third time point before the image printing is started;

a second acquiring unit configured to acquire fourth information regarding a temperature detected by the second detecting element before the image printing is started;

a third acquiring unit configured to acquire fifth information regarding a correction value for correcting the temperature detected by the first detecting element after the third time point;

a correcting unit configured to correct the temperature detected by the first detecting element based on the correction value described in the fifth information acquired by the third acquiring unit after the third time point; and a control unit configured to control driving of the print head based on the temperature corrected by the correcting unit, wherein the third acquiring unit (i) acquires the fifth information regarding the correction value based on the temperature described in the third information acquired by the first acquiring unit and the temperature described in the fourth information acquired by the second acquiring unit in a case where a temperature difference between the temperature described in the first information and the temperature described in the second information acquired by the first acquiring unit is lower than a predetermined threshold, and (ii) acquires the fifth information regarding the correction value without using the fourth information acquired by the second acquiring unit in a case where the temperature difference between the temperature described in the first information acquired by the first acquiring unit and the temperature described in the second information is higher than the predetermined threshold.

16. An ink-jet printing method using an ink-jet printing to which a print head is mountable and having a second detecting element configured to detect a temperature; for printing an image by driving the print head, the print head having at least a plurality of printing elements configured to generate power for discharging ink and a first detecting element configured to detect a temperature, the ink-jet printing method comprising:

first acquiring first information regarding a temperature detected by the first detecting element at a first time point after the print head is mounted to the ink-jet printing apparatus and acquire second information regarding a temperature detected by the first detecting element at a second time point after the first time point and before image printing is started;

secondly acquiring third information regarding a temperature detected by the second detecting element before the image printing is started;

thirdly acquiring fourth information regarding a correction value for correcting the temperature detected by the first detecting element after the second time point;

correcting the temperature detected by the first detecting element based on the correction value described in the fourth information acquired by the third acquiring after the second time point; and controlling driving of the print head based on the temperature corrected by the correcting, wherein the third acquiring (i) acquires the fourth information regarding the correction value based on the temperature described in the second information acquired by the first acquiring and the temperature described in the third information acquired by the second acquiring in a case where a temperature difference between the temperature described in the first information and the temperature described in the second information acquired by the first acquiring is lower than a predetermined threshold, and (ii) acquires the fourth information regarding the correction value without using the third information acquired by the second acquiring in a case where the temperature difference between the temperature described in the first information acquired by the first acquiring and the temperature described in the second information is higher than the predetermined threshold.

* * * * *